US010018330B2

(12) United States Patent
Yamada

(10) Patent No.: US 10,018,330 B2
(45) Date of Patent: Jul. 10, 2018

(54) LIGHT FLUX CONTROL MEMBER, LIGHT-EMITTING DEVICE, AND ILLUMINATION DEVICE

(71) Applicant: Enplas Corporation, Saitama (JP)

(72) Inventor: Kyouhei Yamada, Saitama (JP)

(73) Assignee: ENPLAS CORPORATION, Saitama (JP)

( * ) Notice: Subject to any disclaimer, the term of this patent is extended or adjusted under 35 U.S.C. 154(b) by 0 days.

(21) Appl. No.: 15/509,295

(22) PCT Filed: Jun. 24, 2015

(86) PCT No.: PCT/JP2015/068113
§ 371 (c)(1),
(2) Date: Mar. 7, 2017

(87) PCT Pub. No.: WO2016/038975
PCT Pub. Date: Mar. 17, 2016

(65) Prior Publication Data

US 2017/0254512 A1 Sep. 7, 2017

(30) Foreign Application Priority Data

Sep. 11, 2014 (JP) ..... 2014-185333

(51) Int. Cl.
*F21V 13/04* (2006.01)
*F21V 5/00* (2018.01)
(Continued)

(52) U.S. Cl.
CPC ..... *F21V 13/04* (2013.01); *F21V 3/02* (2013.01); *F21V 5/00* (2013.01); *F21V 7/0091* (2013.01); *F21Y 2115/10* (2016.08)

(58) Field of Classification Search
CPC . F21V 5/00; F21V 5/007; F21V 5/045; F21V 5/046; F21V 13/04; F21V 3/02; F21V 7/0091; F21Y 2115/10
See application file for complete search history.

(56) References Cited

U.S. PATENT DOCUMENTS 6,244,727 B1 * 6/2001 Ryan, Jr. ..... F21V 5/048 362/237
2006/0034094 A1 * 2/2006 Asada ..... F21V 7/0091 362/545
(Continued)

FOREIGN PATENT DOCUMENTS

JP 2009-244316 A 10/2009
JP 2011-513913 A 4/2011
(Continued)

OTHER PUBLICATIONS

International Search Report from International Application No. PCT/JP2015/068113 dated Sep. 15, 2015.

*Primary Examiner* — Mary Ellen Bowman
(74) *Attorney, Agent, or Firm* — Brundidge & Stanger, P.C.

(57) ABSTRACT

This light flux control member comprises: two entry surfaces disposed on two sides of a virtual plane serving as a boundary and containing the optical axis of the light-emitting element; a first protruding strip disposed between the two entry surfaces and along the virtual plane, into which light that has exited the light-emitting element enters; two total reflection surfaces, each formed at a position facing the light-emitting element with one of the entry surfaces sandwiched therebetween; two light-guide portions disposed at opposite positions with the first protruding strip sandwiched therebetween; and an exit surface formed on the external surface of each of the light-guide portions. A second light flux control member is disposed so as to cover the first
(Continued)

protruding strip and includes a diffuse transmission portion whereby light that has entered and exited the first protruding strip is transmitted while being diffused.

18 Claims, 14 Drawing Sheets

(51) Int. Cl.

| | |
|---|---|
| ***F21V 7/00*** | (2006.01) |
| ***F21V 3/02*** | (2006.01) |
| *F21Y 115/10* | (2016.01) |

(56) References Cited

U.S. PATENT DOCUMENTS

| | | | | |
|---|---|---|---|---|
| 2006/0250269 | A1* | 11/2006 | Wang | B63B 45/04 340/815.45 |
| 2010/0027256 | A1* | 2/2010 | Kinoshita | F21V 5/04 362/235 |
| 2010/0149801 | A1* | 6/2010 | Lo | F21V 5/04 362/235 |
| 2010/0277903 | A1* | 11/2010 | Bauer | B60Q 1/2696 362/235 |
| 2011/0006688 | A1* | 1/2011 | Shim | F21V 5/08 315/119 |
| 2013/0094218 | A1* | 4/2013 | Wang | F21V 5/04 362/311.02 |
| 2014/0204592 | A1* | 7/2014 | Miyashita | F21V 5/002 362/311.06 |
| 2015/0117016 | A1* | 4/2015 | Kim | F21K 9/64 362/293 |

FOREIGN PATENT DOCUMENTS

| | | | |
|---|---|---|---|
| JP | 2012-28619 | A | 2/2012 |
| JP | 2014-502022 | A | 1/2014 |
| JP | 2014-63761 | A | 4/2014 |
| WO | 2012/004975 | A1 | 1/2012 |
| WO | 2013/157243 | A1 | 10/2013 |

* cited by examiner

LIGHT FLUX CONTROL MEMBER, LIGHT-EMITTING DEVICE, AND ILLUMINATION DEVICE

TECHNICAL FIELD

The present invention relates to a light flux controlling member configured to control a distribution of light emitted from a light emitting element, and a light-emitting device and an illumination apparatus including the light flux controlling member.

BACKGROUND ART

In recent years, in view of energy saving and environmental conservation, illumination apparatus (such as LED bulbs and LED fluorescent tubes) using a light-emitting diode (hereinafter also referred to as "LED") as a light source have been increasingly replacing electric light bulbs and fluorescent tubes.

In commonly used LED fluorescent tubes, a plurality of LEDs are disposed on a substrate at a predetermined interval, and a cover is disposed so as to cover the LEDs (see, for example, PTL 1).

PTL 1 discloses an LED illuminating apparatus in which an LED disposed on a substrate is covered. The LED illuminating apparatus disclosed in PTL 1 includes a substrate, a plurality of LEDs disposed in a line on the substrate, a cylindrical lens having a ridgeline extending along the arrangement direction of the LEDs, and a light transmission cover disposed to cover a plurality of LEDs and the cylindrical lens.

With the LED illuminating apparatus disclosed in PTL 1, light emitted from the LEDs is spread by the cylindrical lens in a direction perpendicular to the arrangement direction of the LEDs. The light having passed through the cylindrical lens passes through the light transmission cover and then emitted to the outside.

CITATION LIST

Patent Literature

PTL 1
Japanese Unexamined Patent Application Publication (Translation of PCT Application) No. 2011-513913

SUMMARY OF INVENTION

Technical Problem

In the LED illuminating apparatus disclosed in PTL 1, however, the distribution of light in the direction perpendicular to the arrangement direction of the LEDs is controlled, but the distribution of light in the arrangement direction of the LEDs of is not controlled. Accordingly, regarding the light distribution in the arrangement direction of the LEDs, the brightness is excessively high at a portion immediately above the LED, and is excessively low at a portion between the LEDs. In this manner, luminance unevenness is disadvantageously caused in the arrangement direction of the LEDs in the LED illuminating apparatus disclosed in PTL 1.

In view of this, an object of the present invention is to provide a light flux controlling member which can control a distribution of light emitted from a light emitting element such that a cover can be uniformly illuminated with a small number of light emitting elements by uniformizing the distribution of light in the arrangement direction of LEDs and a direction perpendicular to the arrangement direction of the LEDs in a case where the light flux controlling member is applied to an illumination apparatus (for example, an LED fluorescent tube) including a plurality of light emitting elements and a cover.

In addition, another object of the present invention is to provide a light-emitting device and an illumination apparatus including the light flux controlling member.

Solution to Problem

A light flux controlling member according to an embodiment of the present invention includes a light flux controlling member main body and is configured to control a distribution of light emitted from a light emitting element, the light flux controlling member main body including: two incidence surfaces disposed on both sides of a virtual plane as a boundary, the virtual plane including an optical axis of the light emitting element, the incidence surfaces being configured to allow incidence of a part of the light emitted from the light emitting element; a first projected line including a first inclined surface, a second inclined surface paired with the first inclined surface, and a first ridgeline configured to connect the first inclined surface and the second inclined surface, the first projected line being disposed such that the first ridgeline covers the light emitting element along the virtual plane at a position between the two incidence surfaces, the first projected line being configured to allow incidence of another part of the light emitted from the light emitting element; two total reflection surfaces formed at positions opposite to the light emitting element with the incidence surface therebetween, the two total reflection surfaces being configured to reflect a part of light incident on the incidence surface in two opposite directions which are substantially perpendicular to the optical axis; two light guiding parts disposed at respective opposing positions with the incidence surface, the first projected line and the total reflection surface therebetween, the two light guiding parts being configured to guide a part of the light incident on the incidence surface and light reflected by the total reflection surface; and two emission surfaces formed on an external surface of the light guiding part and configured to emit light guided by the light guiding part to outside of the light flux controlling member main body.

In addition, a light-emitting device according to the embodiment of the present invention includes: a light emitting element; and the light flux controlling member.

In addition, an illumination apparatus according to the embodiment of the present invention includes: a plurality of the light-emitting devices; and a cover disposed to cover the plurality of light-emitting devices with an air layer interposed between the cover and each of the light-emitting devices.

Advantageous Effects of Invention

According to the present invention, an illumination apparatus (for example, LED fluorescent tube) which can suppress luminance unevenness can be provided.

DESCRIPTION OF EMBODIMENT

In the following, an embodiment of the present invention is described in detail with reference to the accompanying drawings. The following description explains an illumination apparatus which can be used in place of fluorescent tubes, as a typical example of the illumination apparatus according to the embodiments of the present invention.

(Configuration of Illumination Apparatus)

Figure 1A:
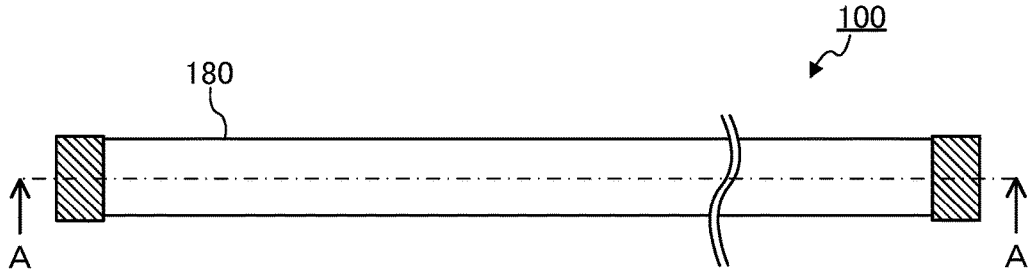
FIG. 1A to FIG. 1C illustrate a configuration of an illumination apparatus according to an embodiment.
Figure 1B:
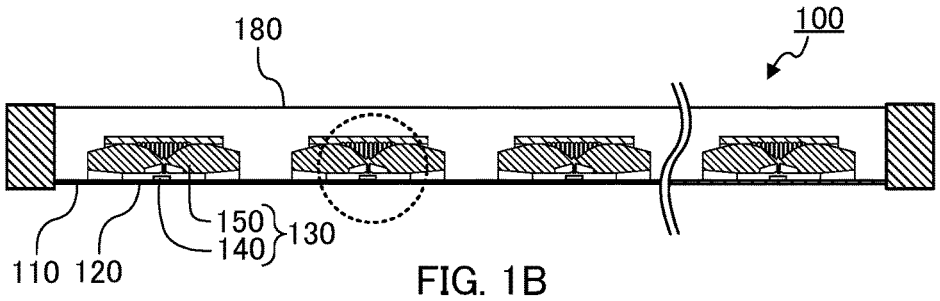
Figure 1C:
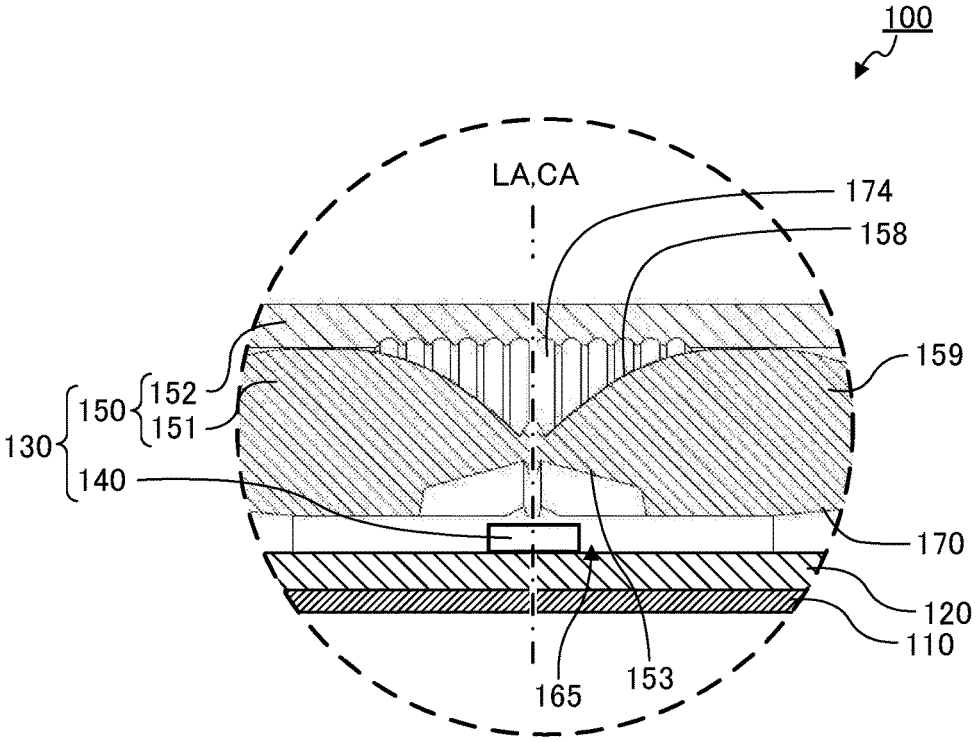

FIG. 1A to FIG. 1C illustrate a configuration of illumination apparatus 100 according to an embodiment of the present invention. FIG. 1A is a plan view of illumination apparatus 100, FIG. 1B is a sectional view taken along line A-A of FIG. 1A, and FIG. 1C is a partially enlarged view of the portion enclosed with a broken line in FIG. 1B.

As illustrated in FIG. 1A to FIG. 1C, illumination apparatus 100 includes frame (casing) 110, substrate 120, a plurality of light-emitting devices 130 each including light emitting element 140 and light flux controlling member 150, and cover 180. Light flux controlling members 150 are disposed in a line on substrate 120 such that each light flux controlling member 150 is paired with a light emitting element 140.

Light emitting elements 140 serve as a light source of illumination apparatus 100, and are disposed in a line on substrate 120 attached on frame 110. Each light emitting element 140 is disposed at a position opposite to incidence surface 153 of light flux controlling member 150 described later. Light emitting element 140 is a light-emitting diode (LED) such as a white light-emitting diode for example. Frame 110 and substrate 120 are made of, for example, a metal having a high thermal conductivity such as aluminum and copper. When substrate 120 is not need to have high thermal conductivity, substrate 120 may be composed of a resin substrate having glass nonwoven fabric impregnated with epoxy resin.

Cover 180 allows light emitted from light flux controlling member 150 to pass therethrough to the outside while diffusing the light. Cover 180 is disposed to cover all light-emitting devices 130 with an air layer therebetween. The external surface of cover 180 corresponds to an effective light emission region.

The shape of cover 180 is not limited as long as all light-emitting devices 130 can be covered with an air layer therebetween. The shape of cover 180 may be a cylindrical shape, or a shape which is obtained by partially cutting out a cylindrical shape. In the present embodiment, cover 180 has a shape which is obtained by partially cutting out a cylindrical shape. The material of cover 180 is not limited as long as the material has light transmissivity. Examples of the material of cover 180 include light transmissive resins such as polymethylmethacrylate (PMMA), polycarbonate (PC), polystyrene (PS), and styrene methyl methacrylate copolymerization resin (MS), and light transmissive glasses. In addition, the method for providing cover 180 with a light diffusing function is not limited. For example, a light diffusing treatment (for example, roughening treatment) may be performed on the internal surface or the external surface of cover 180, or a diffusing member such as beads may be dispersed in the light transmissive resins.

(Configuration of Light Flux Controlling Member)

Figure 2:
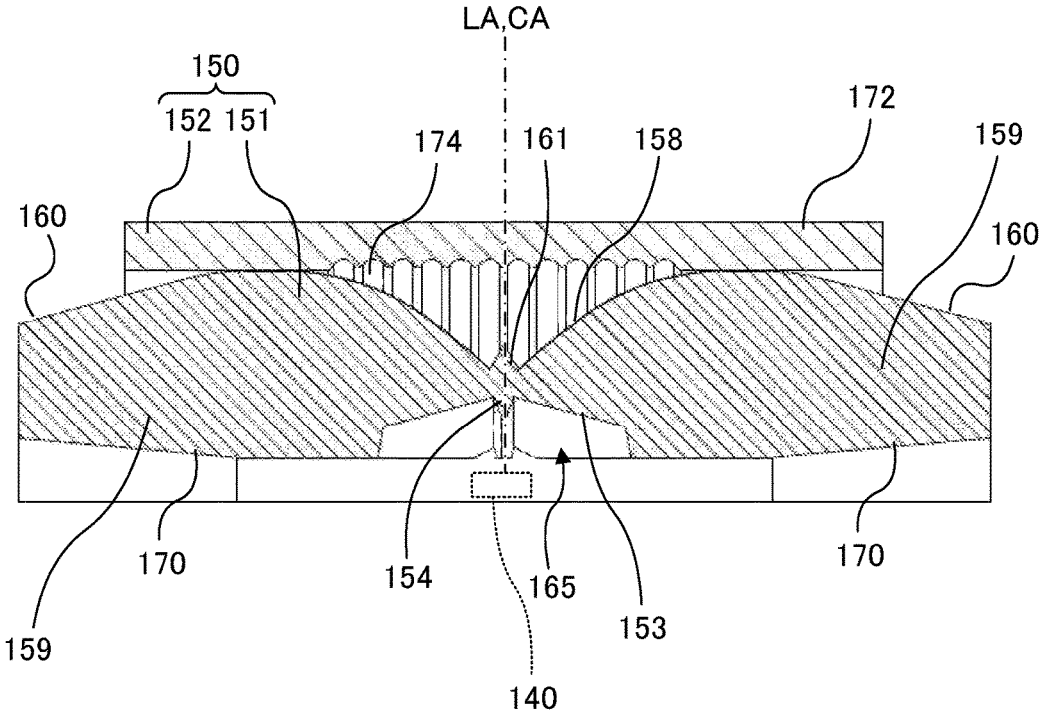
FIG. 2 is a sectional view of a light flux controlling member according to the embodiment.

FIG. 2 is a sectional view of light flux controlling member 150 according to the present embodiment. As illustrated in FIG. 2, light flux controlling member 150 includes first light flux controlling member (light flux controlling member main body) 151 and second light flux controlling member (diffusion transmission member) 152. Light flux controlling member 150 controls the distribution of light emitted from light emitting element 140. First light flux controlling member 151 and second light flux controlling member 152 are separately formed by integral molding. The material of first light flux controlling member 151 and second light flux controlling member 152 is not limited as long as light of a desired wavelength can pass therethrough. Examples of the material of first light flux controlling member 151 and second light flux controlling member 152 include: light transmissive resins such as polymethylmethacrylate (PMMA), polycarbonate (PC), and epoxy resin (EP), and light transmissive glass. In addition, light diffusing members such as beads may be dispersed in first light flux controlling member 151 and second light flux controlling member 152.

Figure 3A:
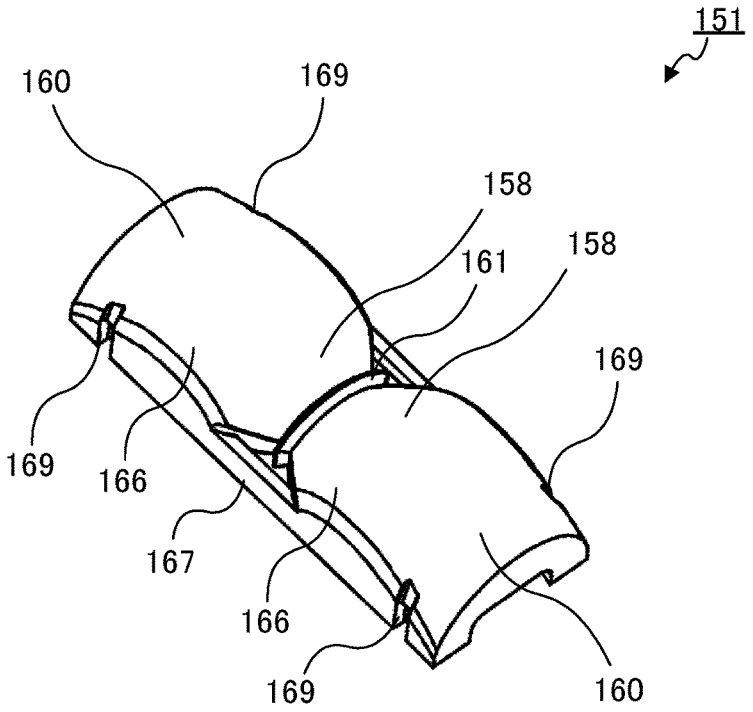
FIG. 3A and FIG. 3B are perspective views illustrating a configuration of a first light flux controlling member.
Figure 3B:
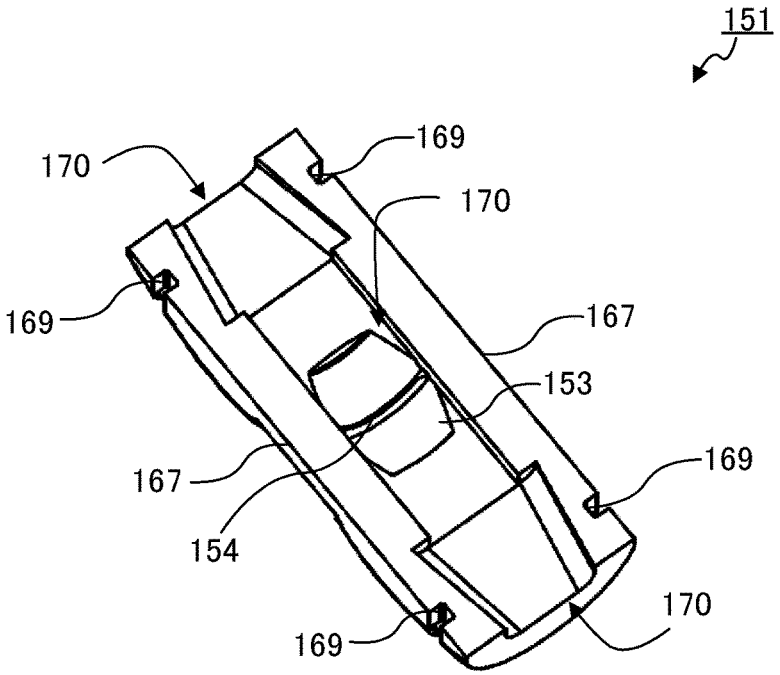

FIG. 3A to FIG. 5D illustrate a configuration of first light flux controlling member 151. FIG. 3A is a perspective view of first light flux controlling member 151 as viewed from the upper side, and FIG. 3B is a perspective view of first light flux controlling member 151 as viewed from the lower side.

Figure 4A:
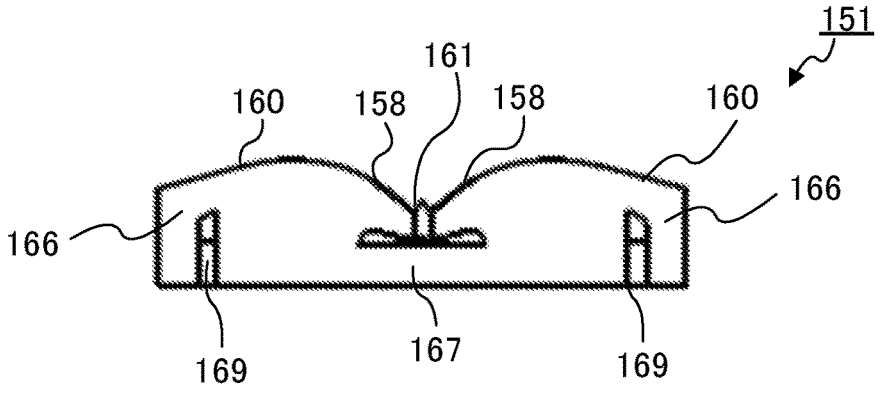
FIG. 4A to FIG. 4C illustrate a configuration of the first light flux controlling member.
Figure 4B:
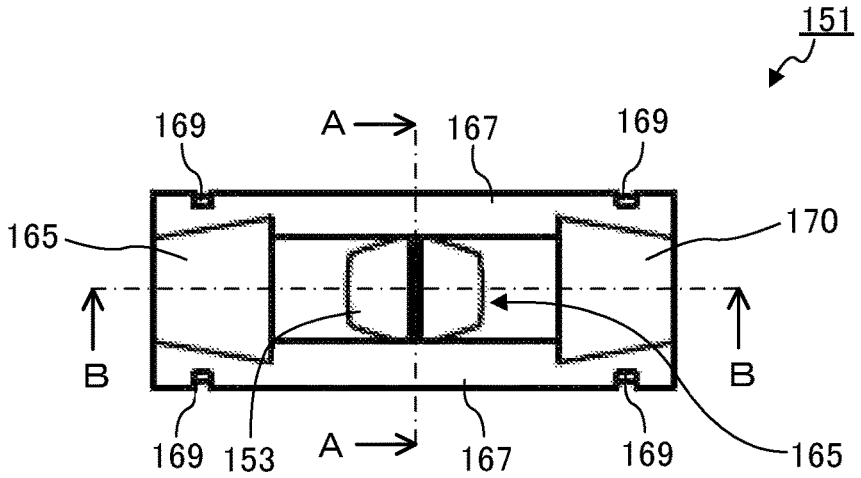
Figure 4C:
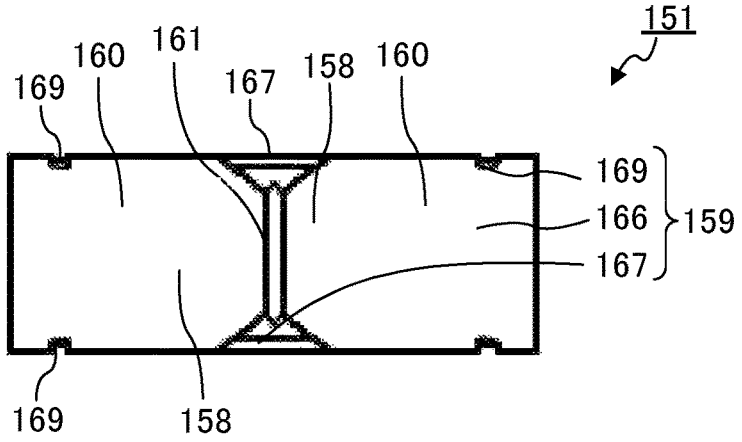
Figure 5A:
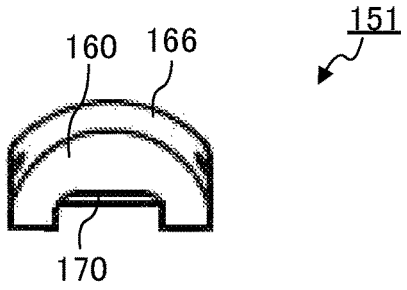
FIG. 5A to FIG. 5D illustrate a configuration of the first light flux controlling member.
Figure 5B:
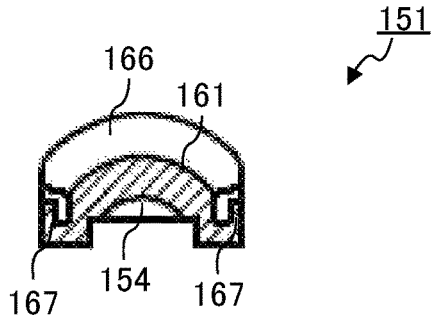
Figure 5C:
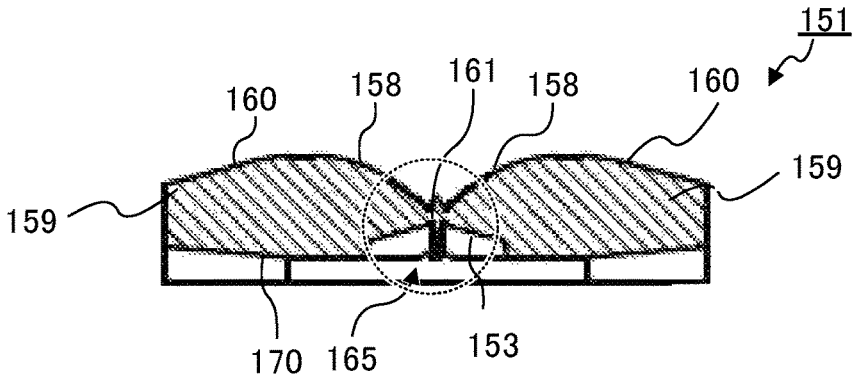
Figure 5D:
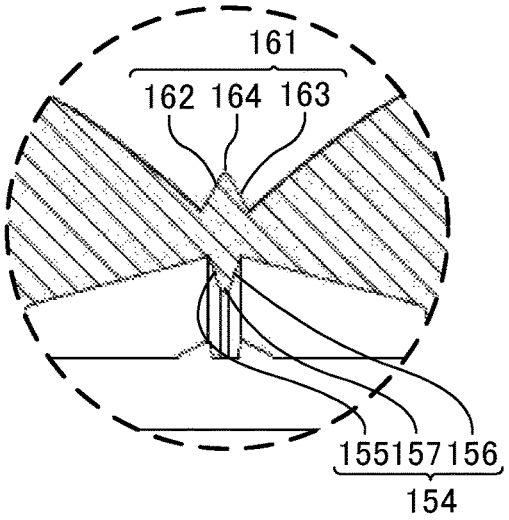

FIG. 4A is a front view of first light flux controlling member 151, FIG. 4B is a bottom view of first light flux controlling member 151, and FIG. 4C is a plan view of first light flux controlling member 151. FIG. 5A is a side view of first light flux controlling member 151, FIG. 5B is a sectional view taken along line A-A of FIG. 4B, FIG. 5C is a sectional view taken along line B-B of FIG. 4B, and FIG. 5D is a partially enlarged view of the portion enclosed with a broken line in FIG. 5C.

As illustrated in FIG. 3A to FIG. 5D, first light flux controlling member (light flux controlling member main body) 151 includes two incidence surfaces 153, first projected line 154, two total reflection surfaces 158, two light guiding parts 159, two emission surfaces 160 and second projected line 161. First light flux controlling member 151 is disposed such that optical axis LA of light emitting element 140 passes through first ridgeline 157 of first projected line 154. Here, "optical axis of light emitting element" is the travelling direction of light at the center of a stereoscopic light flux from the light emitting element 140.

Each incidence surface 153 allows a part of light emitted from light emitting element 140, which is a point light source such as an LED, to enter first light flux controlling member 151. Incidence surface 153 is a part of the internal surface of first recess 165 formed at a center portion of the bottom surface (the surface on light emitting element 140 side) of first light flux controlling member 151. Two incidence surfaces 153 are disposed on the both sides of a virtual plane, as a boundary, which includes optical axis LA a light emitting element and is perpendicular to substrate 120. The shape of first recess 165 is not limited. Preferably, the shape of first recess 165 is an edgeless curved surface. First projected line 154 allows another part of the light emitted from light emitting element 140 to enter first light flux controlling member 151, and refracts the incident light. First projected line 154 includes first inclined surface 155, second inclined surface 156 paired with first inclined surface 155, and first ridgeline 157 that connects first inclined surface 155 and second inclined surface 156 (see FIG. 5D). First projected line 154 is disposed such that first ridgeline 157 covers light emitting element 140 along the virtual plane disposed at a position between two incidence surfaces 153. That is, first ridgeline 157 is located on the virtual plane. First inclined surface 155 and second inclined surface 156 are a part of the internal surface of first recess 165. The shape of first projected line 154 is not limited as long as the above-described function can be ensured. The shape of first projected line 154 in a cross section orthogonal to first ridgeline 157 is a triangular shape, for example. In this case, the corner including first ridgeline 157 may be chamfered. In the present embodiment, the cross-sectional shape of first projected line 154 is a nearly triangular shape whose corner including first ridgeline 157 is chamfered. The smaller angle between first inclined surface 155 and second inclined surface 156 (hereinafter referred to also as "first angle") is not limited as long as the above-described function can be ensured. In the present embodiment, the first angle falls within a range of 40° to 160°. In the case where a first light flux controlling member having first projected line 154 whose first angle is smaller than 40° is used, the quantity of light which reaches second projected line 161 is small depending on the type of light emitting element 140, and a dark point may possibly be formed at a portion immediately above light emitting element 140 on cover 180 when second light flux controlling member 152 is disposed between first light flux controlling member 151 and cover 180. In this case, second light flux controlling member 152 is not provided so that light emitted from first light flux controlling member 151 directly reaches cover 180 whereby reduction in quantity of light can be suppressed, and the uniformity of the brightness on cover 180 can be improved with only first light flux controlling member 151. On the other hand, in the case where the first angle is greater than 160°, the quantity of light which reaches second projected line 161 is excessively large, and a bright spot may possibly be formed at a portion immediately above light emitting element 140. In addition, in the virtual plane, first ridgeline 157 is a curve protruding toward cover 180. It is to be noted that, in illumination apparatus 100, the first angle may be appropriately set in accordance with a desired quantity of the light which reaches a portion immediately above light emitting element 140. In addition, in the virtual plane, first projected line 154 preferably allows incidence of light emitted from light emitting element 140 at an angle of at least 45° with respect to optical axis LA of light emitting element 140. Light having reached first projected line 154 is refracted toward the virtual plane by first inclined surface 155 or second inclined surface 156.

Two total reflection surfaces 158 reflect a part of light incident on incidence surface 153 in two opposite directions (directions of two light guiding parts 159) which are substantially perpendicular to optical axis LA of light emitting element 140 and the virtual plane. That is, two total reflection surfaces 158 reflect light having reached two total reflection surfaces 158 toward two light guiding parts 159. Two total reflection surfaces 158 are formed at positions opposite to light emitting element 140 with incidence surface 153 therebetween. Two total reflection surfaces 158 are disposed on the both sides of the virtual plane as a boundary.

Figure 6A:
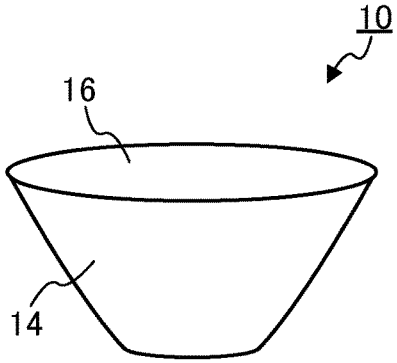
FIG. 6A to FIG. 6E illustrate a total reflection surface.
Figure 6B:
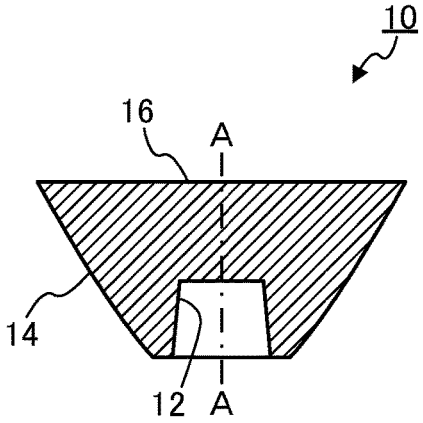

With reference to FIG. 6A to FIG. 6E, the shape of total reflection surface 158 is described. FIG. 6A and FIG. 6B illustrate a configuration of light flux controlling member 10 that includes a light emitting element as a light source and is used for a spotlight. FIG. 6A is a perspective view of light flux controlling member 10, and FIG. 6B is a sectional view of light flux controlling member 10. As illustrated in FIG. 6A and FIG. 6B, light flux controlling member 10 includes: incidence surface 12 on which light emitted from a light emitting element is incident; total reflection surface 14 that totally reflects a part of light incident on incidence surface 12; and emission surface 16 configured to emit a part of light incident on incidence surface 12 and light reflected by total reflection surface 14. Incidence surface 12 is an internal surface of a truncated cone shaped recess that is formed on a bottom of light flux controlling member 10. Total reflection surface 14 is a surface extending from the outer edge of the bottom of light flux controlling member 10 to the outer edge of emission surface 16, and is a rotationally symmetrical surface formed in such a manner as to surround the central axis of light flux controlling member 10. The diameter of total reflection surface 14 gradually increases from incidence surface 12 side (bottom side) toward emission surface 16 side. The generatrix of total reflection surface 14 is an arc-like curve protruding outward. Emission surface 16 is a planar surface located at a position opposite to incidence surface 12 (bottom) in light flux controlling member 10.

Figure 6C:
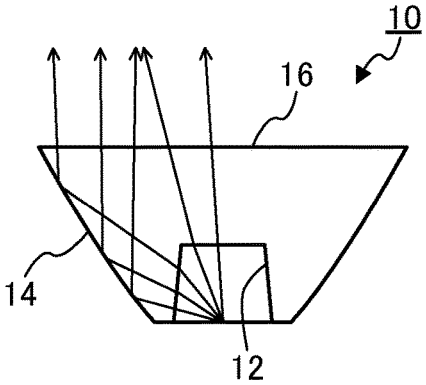

FIG. 6C illustrates light paths in the case where light flux controlling member 10 is used. As illustrated in FIG. 6C, light emitted from a point light source disposed at a predetermined position enters light flux controlling member 10 from incidence surface 12. A part of the light having entered light flux controlling member 10 is directly output from emission surface 16. The remaining part of the light having entered light flux controlling member 10 is reflected by total reflection surface 14 toward emission surface 16, and output from emission surface 16. In this manner, the distribution of light emitted from the point light source is controlled and the light is output from emission surface 16.

Figure 6D:
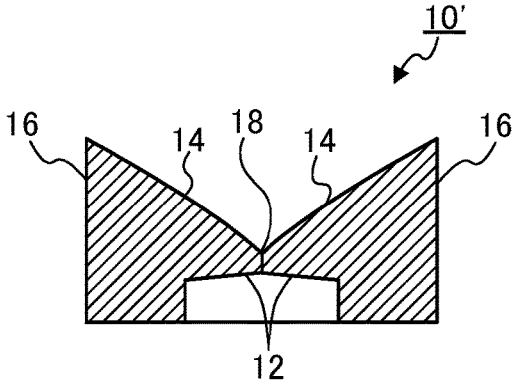
Figure 6E:
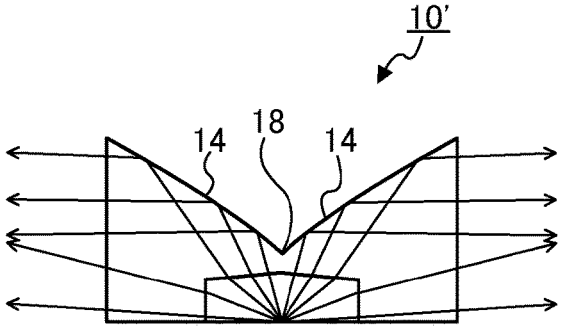

When light flux controlling member 10 is divided into two parts along line A-A of FIG. 6B and the bottoms of the two parts are connected, light flux controlling member 10' illustrated in FIG. 6D is obtained. As illustrated in FIG. 6E, in light flux controlling member 10' thus obtained, light emitted from the point light source is reflected by two total reflection surfaces 14 and becomes two beams of light travelling in two opposite directions. The shape of total reflection surface 158 of first light flux controlling member 151 of the present embodiment is basically the same as the shape of total reflection surface 14 of light flux controlling member 10' illustrated in FIG. 6D. In the following description, the portion denoted by the reference sign "18" in the proximity of the boundary line of two total reflection surfaces 14 in FIG. 6D and FIG. 6E is referred to also as "connecting section of total reflection surface." In addition, at this time, the boundary line of total reflection surface 14 is an arc.

Two light guiding parts 159 are disposed at opposing positions (both sides of the virtual plane) with incidence surface 153, first projected line 154, total reflection surface 158 and second projected line 161 therebetween. Light guiding part 159 guides a part of light incident on incidence surface 153 and light reflected by total reflection surface 158 in the direction away from incidence surface 153 and total reflection surface 158, while emitting the part of the light incident on incidence surface 153 and the light reflected by total reflection surface 158 to the outside little by little. Light guiding part 159 includes light guiding part main body 166, a pair of reinforcement members 167 and four guide engagement grooves 169. The external surface of light guiding part main body 166 functions as emission surface 160 that emits the guided light to the outside.

Preferably, a scattering member such as beads is dispersed in light guiding part 159 from the viewpoint of uniformizing the quantity of light emitted from emission surface 160. In addition, a light diffusion treatment (for example, roughening process) may be performed on emission surface 160.

The shape of light guiding part 159 is not limited. In the present embodiment, the shape of light guiding part 159 is a rod-like shape. Two light guiding parts 159 are connected with respective emission surfaces 16 of light flux controlling member 10' illustrated in FIG. 6D. The cross-sectional area of light guiding part 159 in the minor axis direction is not limited. In the present embodiment, the cross-sectional area of light guiding part 159 decreases as the distance from total reflection surface 158 increases. It is to be noted that the cross-sectional area of light guiding part 159 in the minor axis direction may not be changed in the longitudinal axial direction of light guiding part 159. In the case where the cross-sectional area of light guiding part 159 in the minor axis direction decreases as the distance from total reflection surface 158 increases, the cross-sectional area may be controlled by adjusting the thickness and the width of light guiding part 159, or by adjusting one of the thickness and the width of light guiding part 159. In addition, the cross-sectional shape of light guiding part 159 in the minor axis direction is not limited, and may be appropriately selected in accordance with required light distribution characteristics. In the present embodiment, in the virtual plane, light guiding part 159 has a nearly semicircular shape.

In addition, second recesses 170 are respectively formed on the bottom surfaces (the surfaces on light emitting element 140 side in optical axis LA direction of light emitting element 140) of light guiding part main bodies 166. By forming second recess 170, formation of sink marks at the time of injection molding can be suppressed, and the manufacturing cost can be reduced. Two second recesses 170 are formed at the both end portions of first light flux controlling member 151 in the longitudinal axial direction, and are communicated with first recess 165.

The size and the shape of second recess 170 are not limited as long as the desired light distribution (the light distribution which does not reduce the effect of the present invention) can be obtained and as a required strength of first light flux controlling member 151 can be ensured. In the present embodiment, the shape of second recess 170 in plan view is a nearly trapezoidal shape whose bottom side is located on light emitting element 140 (see FIG. 3B). In addition, the depth of second recess 170 is not limited, and may be appropriately set. It is to be noted that, in the case where first light flux controlling member 151 is formed by injection molding, it is preferable to form second recess 170 in a region where sink marks are possibly formed.

Reinforcement member 167 improves the strength of first light flux controlling member 151. The position and the shape of reinforcement member 167 are not limited as long as the function of total reflection surface 158 of first light flux controlling member 151 is not significantly impaired, and as the strength of first light flux controlling member 151 can be improved. In the present embodiment, reinforcement member 167 is disposed on the bottom surface side of first light flux controlling member 151 (surface on light emitting element 140 side) in such a manner as to join the side surfaces of light guiding part 159. It is to be noted that, although not illustrated in the drawings, a positioning protrusion for setting the position of light flux controlling member 150 with respect to substrate 120 is disposed on the rear surface of reinforcement member 167.

Guide engagement grooves 169 are disposed at respective positions remote from light emitting element 140. Guide engagement grooves 169 are grooves for setting the position of second light flux controlling member 152 with respect to first light flux controlling member 151 by engagement with engagement protrusions 171 of second light flux controlling member 152 described later.

Second projected line 161 emits a part of light incident on first projected line 154 to the outside of first light flux controlling member 151 while refracting the light. Second projected line 161 includes third inclined surface 162, fourth inclined surface 163 paired with third inclined surface 162, and second ridgeline 164 that connects third inclined surface 162 and fourth inclined surface 163 (see FIG. 5D). Second projected line 161 is disposed such that second ridgeline 164 covers first projected line 154 along the virtual plane at a position between two total reflection surfaces 158. That is, second ridgeline 164 is located on the virtual plane. The shape of second projected line 161 is not limited as long as the above-described function can be ensured. The shape of second projected line 161 in the cross section orthogonal to second ridgeline 164 is a triangular shape, for example. In this case, the corner including second ridgeline 164 may be chamfered. In the present embodiment, the cross-sectional shape of second projected line 161 is a nearly triangular shape whose corner including second ridgeline 164 is chamfered. The smaller angle between third inclined surface 162 and fourth inclined surface 163 (hereinafter referred to also as "second angle") is not limited as long as the above-described function can be ensured. In the present embodiment, the second angle falls within a range of 60° to 160°.

In the case where a first light flux controlling member having second projected line 161 whose second angle is smaller than 60° is used, emission light is excessively refracted depending on the type of light emitting element 140, and a dark point may possibly be formed at a portion immediately above light emitting element 140 on cover 180 when second light flux controlling member 152 is disposed between first light flux controlling member 151 and cover 180. In this case, second light flux controlling member 152 is not provided so that light emitted from first light flux controlling member 151 directly reaches cover 180 whereby reduction in quantity of light can be suppressed, and the uniformity of the brightness on cover 180 can be improved with only first light flux controlling member 151. On the other hand, in the case where the second angle is greater than 160°, emission light may not be sufficiently refracted, resulting in a bright spot formed at a portion immediately above light emitting element 140. In addition, in the virtual plane, second ridge-line 164 is a curve protruding toward cover 180.

As illustrated in FIG. 2, second light flux controlling member (diffusion transmission member) 152 is disposed over first light flux controlling member 151 with an air layer therebetween to cover incidence surfaces 153, first projected line 154 and total reflection surface 158 and intersect the virtual plane (or intersect optical axis LA). Second light flux controlling member 152 allows light emitted from first light flux controlling member 151 (mainly second projected line 161) to pass therethrough while diffusing the light. The shape of second light flux controlling member 152 is not limited as long as the above-described function can be ensured. Examples of the shape of second light flux controlling member 152 include a temple bell-like shape (inverted U-shape), a half cylindrical shape and the like in a cross section along the virtual plane. In the present embodiment, the shape of second light flux controlling member 152 has a temple bell-like shape (inverted U-shape) in a cross section along the virtual plane.

Figure 7A:
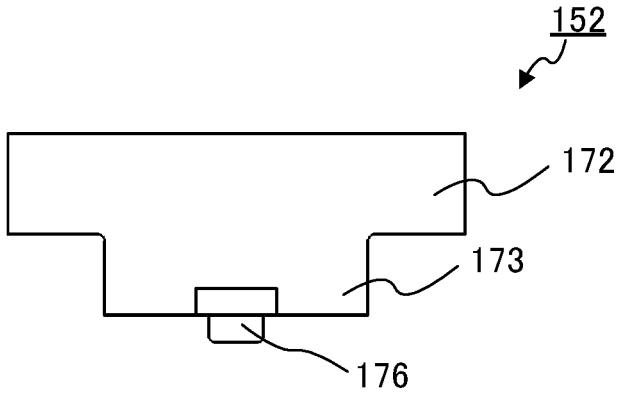
FIG. 7A to FIG. 7C illustrate a configuration of a second light flux controlling member.
Figure 7B:
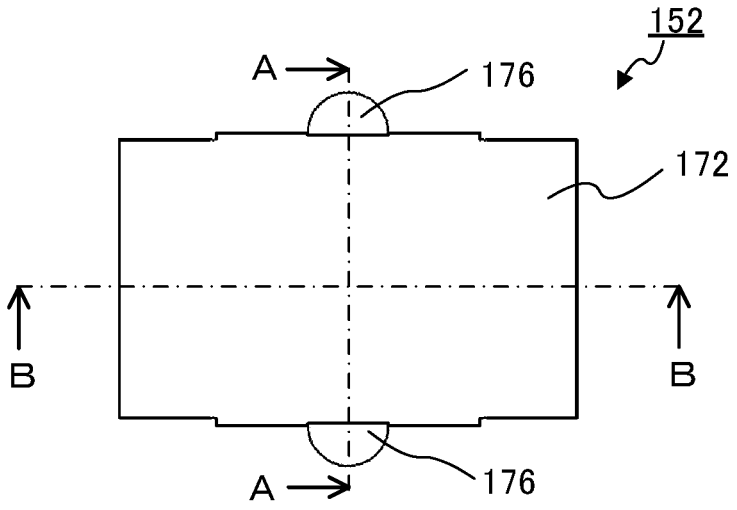
Figure 7C:
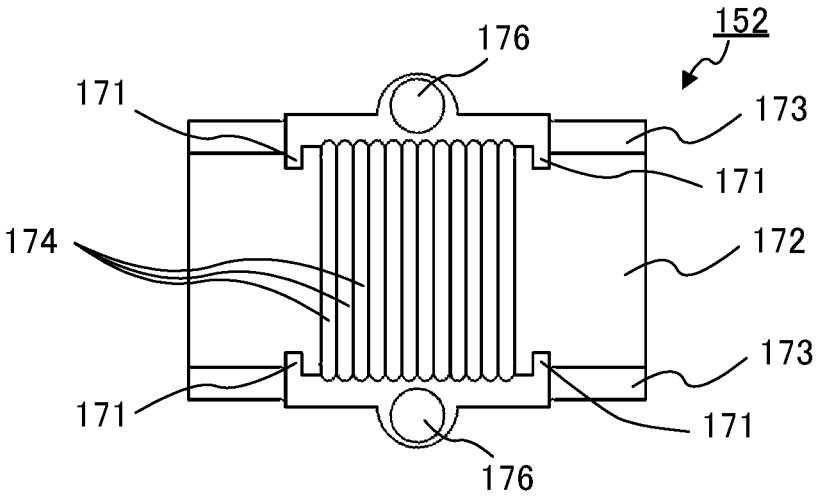
Figure 8A:
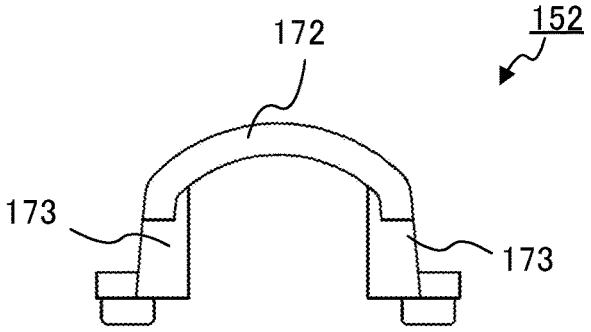
FIG. 8A to FIG. 8C illustrate a configuration of the second light flux controlling member.
Figure 8B:
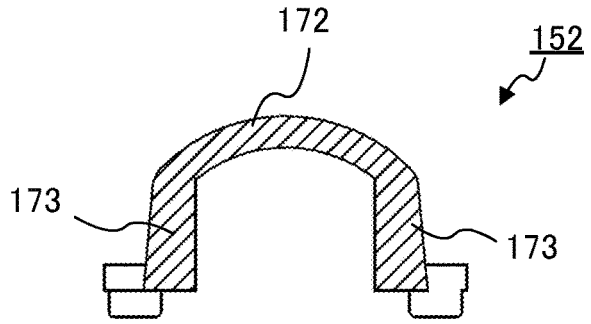
Figure 8C:
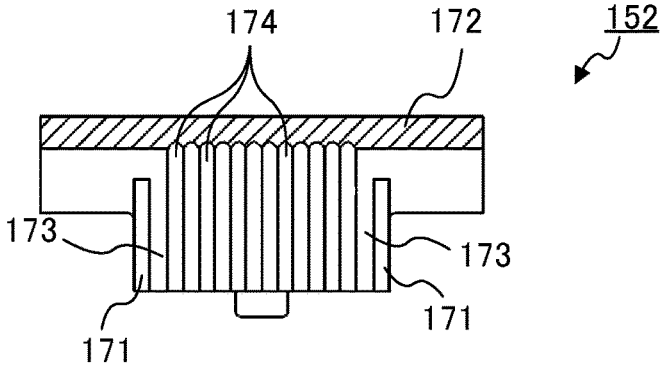

FIG. 7A to FIG. 8C illustrate a configuration of second light flux controlling member 152. FIG. 7A is a front view of second light flux controlling member 152, FIG. 7B is a plan view of second light flux controlling member 152, and FIG. 7C is a bottom view of second light flux controlling member 152. FIG. 8A is a side view of second light flux controlling member 152, FIG. 8B is a sectional view taken along line A-A of FIG. 7B, and FIG. 8C is a sectional view taken along line B-B of FIG. 7B. As illustrated in FIG. 7A to FIG. 8C, second light flux controlling member 152 includes half cylinder part 172 and two side wall parts 173.

Half cylinder part 172 is disposed in a region around a portion immediately above total reflection surface 158. A plurality of recessed lines (diffusion transmission part) 174 are formed on the internal surface of half cylinder part 172. Each recessed line 174 is disposed in a semi-annular form in a direction perpendicular to the direction of the axis of second light flux controlling member 152 (a direction along the virtual plane). Here, "the axis of second light flux controlling member 152" is the axial line of half cylinder part 172.

Two side wall parts 173 are continuously connected with respective side edges of half cylinder part 172. Recessed lines 174 (diffusion transmission part) are formed at a center portion of the internal surface of side wall part 173. Recessed lines 174 are linearly disposed in a direction perpendicular to the direction of the axis of second light flux controlling member 152 (a direction along the virtual plane). In addition, recessed lines 174 disposed in half cylinder part 172 and recessed lines 174 disposed in side wall part 173 which correspond to recessed lines 174 disposed in half cylinder part 172 are respectively connected to each other. Recessed line 174 allows arrival light to pass therethrough while diffusing the light. The cross-sectional shape of recessed line 174 is not limited. Examples of the cross-sectional shape of recessed line 174 include a semicircular shape and a triangular shape. In the present embodiment, recessed line 174 has a semicircular cross-sectional shape. The shapes of recessed lines 174 may be identical to each other, or different from each other. In the present embodiment, the shapes of recessed lines 174 are identical to each other.

In addition, four engagement protrusions 171 are disposed at both end portions on the internal side of side wall part 173. When engaged with four guide engagement grooves 169 of first light flux controlling member 151, four engagement protrusions 171 set the position of second light flux controlling member 152 with respect to first light flux controlling member 151. At an end portion of side wall part 173 which is not continuously connected with half cylinder part 172, protrusion part 176 for positioning and fixing of second light flux controlling member 152 to substrate 120 is disposed. When guide engagement grooves 169 of first light flux controlling member 151 fixed to substrate 120 are engaged with engagement protrusions 171 of second light flux controlling member 152, and protrusion parts 176 of second light flux controlling member 152 are fitted to engagement recesses of substrate 120 (omitted in the drawing), second light flux controlling member 152 can be fixed to substrate 120 and first light flux controlling member 151.

A part of light emitted from light emitting element 140 enters first light flux controlling member 151 from incidence surface 153. The light having entered light flux controlling member 150 is reflected at total reflection surface 158 toward light guiding part 159. Further, another part of the light having entered first light flux controlling member 151 (light emitted at a large angle with respect to optical axis LA of light emitting element 140) directly reaches light guiding part 159. In addition, a part of light which is emitted from light emitting element 140 and is incident on first projected line 154 is refracted toward total reflection surface 158, and guided to light guiding part 159. In addition, another part of the light incident on first projected line 154 is refracted toward second projected line 161.

Light incident on light guiding part 159 is emitted to the outside from emission surface 160 little by little, and guided toward an end portion of light guiding part 159. As a result, substantially uniform light is emitted from the external surface of light flux controlling member 150 in its entirety. On the other hand, light emitted from second projected line 161 and light emitted from the center of light emitting element 140 reach second light flux controlling member 152. The light incident on second light flux controlling member 152 is transmitted to the outside of light flux controlling member 150 while being diffused by recessed lines 174. Light emitted from emission surface 160 of light flux controlling member 150 passes through the air layer and reaches the internal surface of cover 180. The light having reached the internal surface of cover 180 passes through cover 180 while being diffused. As a result, substantially uniform light is emitted from the exterior surface of cover 180 in its entirety. In this manner, with light flux controlling member 150, light emitted from light emitting element 140 that is a point light source can be converted into linear light.

(Simulation of Light Distribution Characteristics of Light Flux Controlling Member)

Light distribution characteristics of a plurality of light flux controlling members 150 which are different from each other in the first angle of first projected line 154 and the second angle of second projected line 161 were examined The light flux controlling members used in the simulation of light distribution characteristics were: a light flux controlling member (hereinafter referred to also as "light flux controlling member A") having a first angle of 40° and a second angle of 60°, a light flux controlling member (hereinafter referred to also as "light flux controlling member B") having a first angle of 40° and a second angle of 100°, a light flux controlling member (hereinafter referred to also as "light flux controlling member C") having a first angle of 40° and a second angle of 160°, a light flux controlling member (hereinafter referred to also as "light flux controlling member D") having a first angle of 160° and a second angle of 60°, a light flux controlling member (hereinafter referred to also as "light flux controlling member E") having a first angle of 160° and a second angle of 100°, and a light flux controlling member (hereinafter referred to also as "light flux controlling member F") having a first angle of 160° and a second angle of 160°.

Figure 9A:
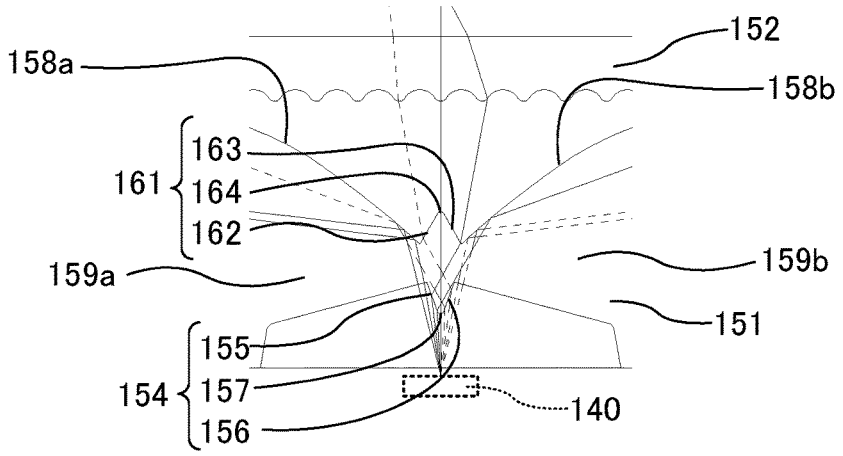
FIG. 9A to FIG. 9C illustrate light paths of light emitted from the center of a light emitting surface of a light emitting element in light flux controlling member A, light flux controlling member B and light flux controlling member C.
Figure 10A:
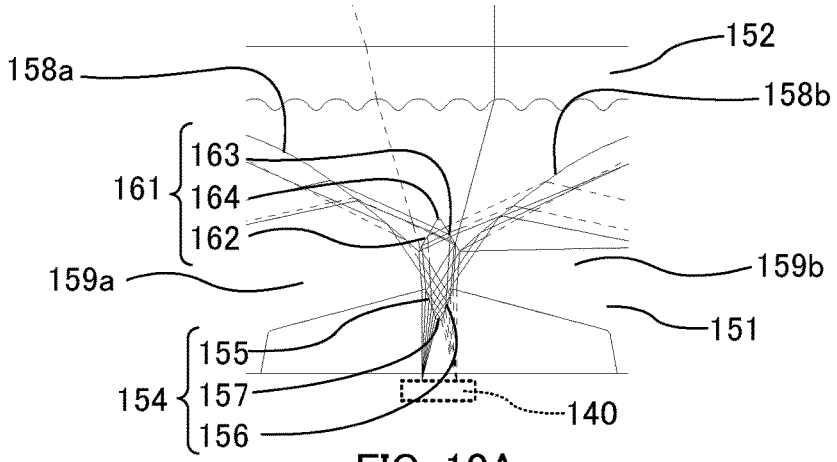
FIG. 10A to FIG. 10C illustrate light paths of light emitted from a region other than the center of the light emitting surface of a light emitting element in light flux controlling member A, light flux controlling member B and light flux controlling member C.
Figure 10B:
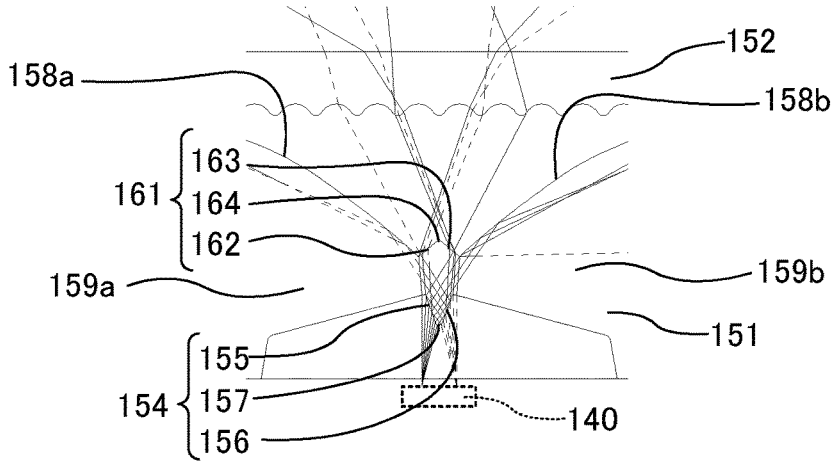
Figure 10C:
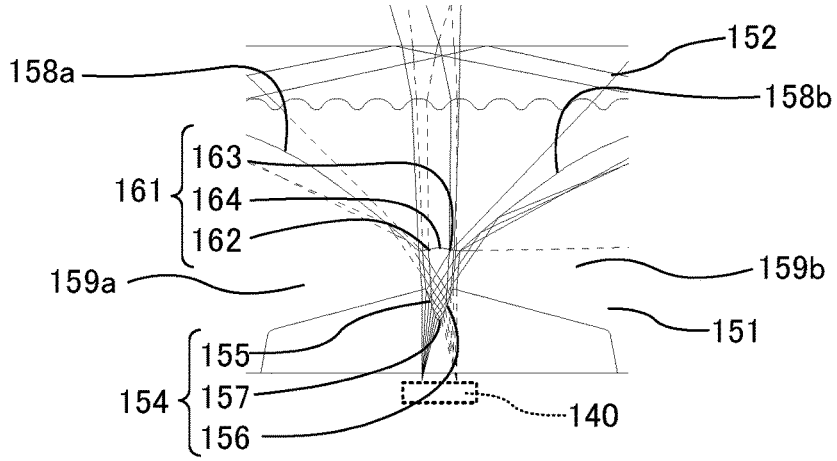
Figure 11A:
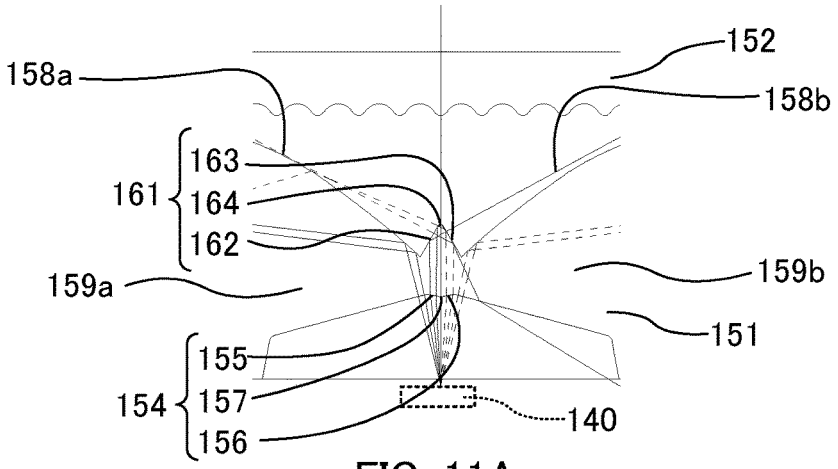
FIG. 11A to FIG. 11C illustrate light paths of light emitted from the center of a light emitting surface of a light emitting element in light flux controlling member D, light flux controlling member E and light flux controlling member F.
Figure 11B:
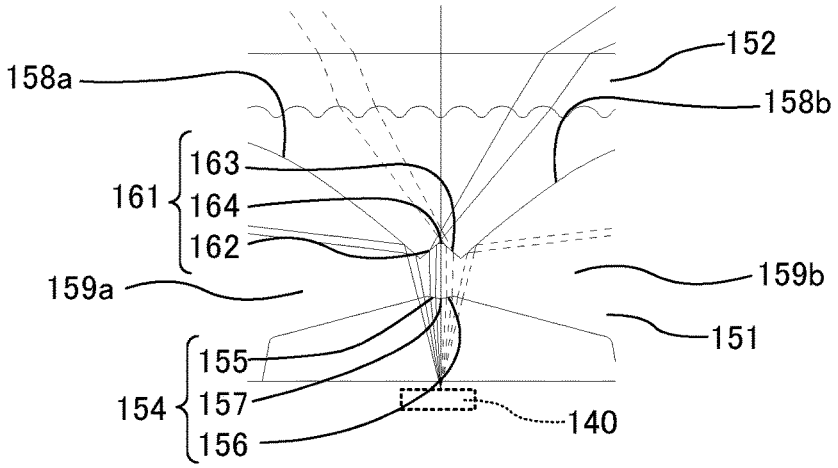
Figure 11C:
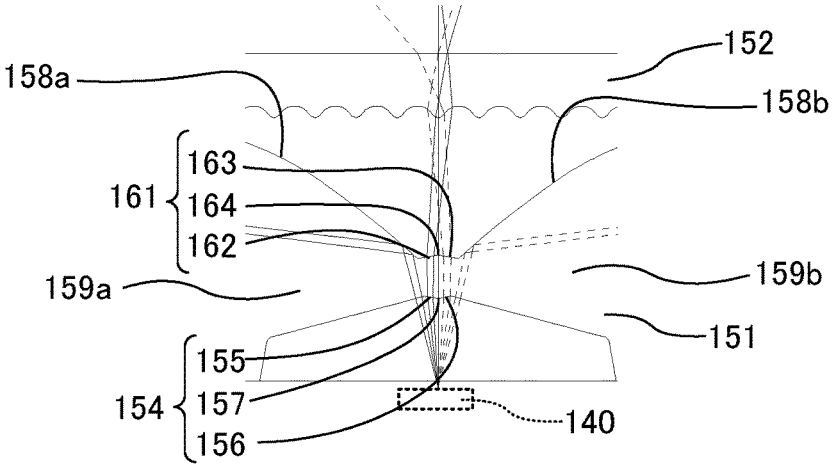
Figure 12A:
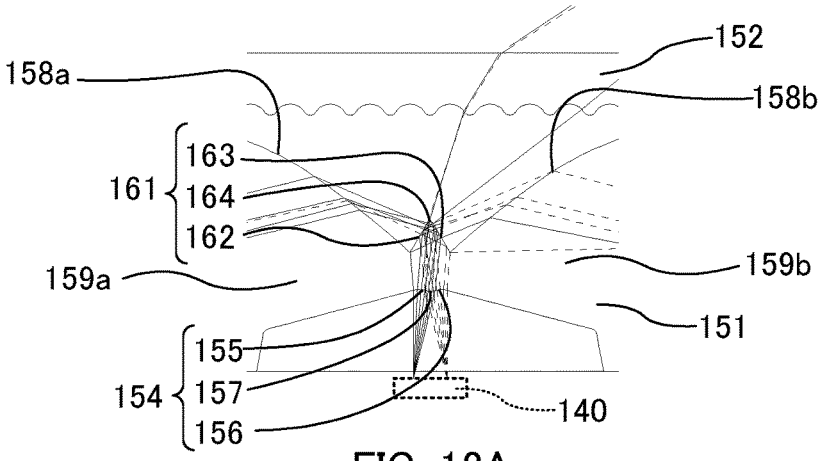
FIG. 12A to FIG. 12C illustrate light paths of light emitted from a region other than the center of the light emitting surface of a light emitting element in light flux controlling member D, light flux controlling member E and light flux controlling member F.
Figure 12B:
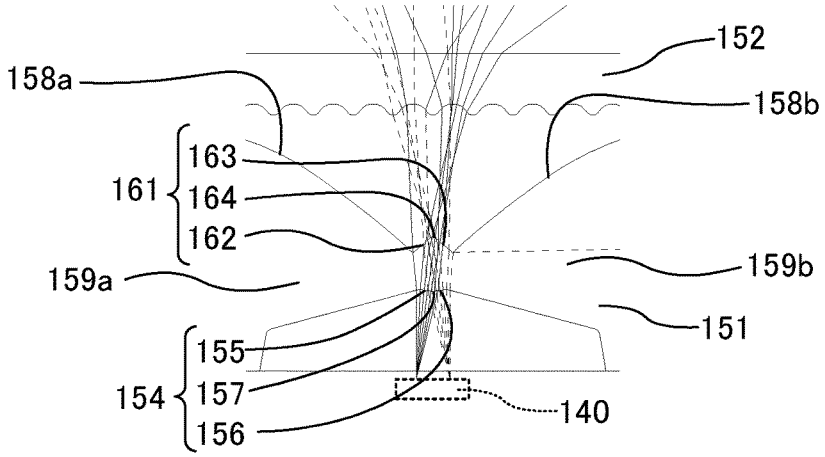
Figure 12C:
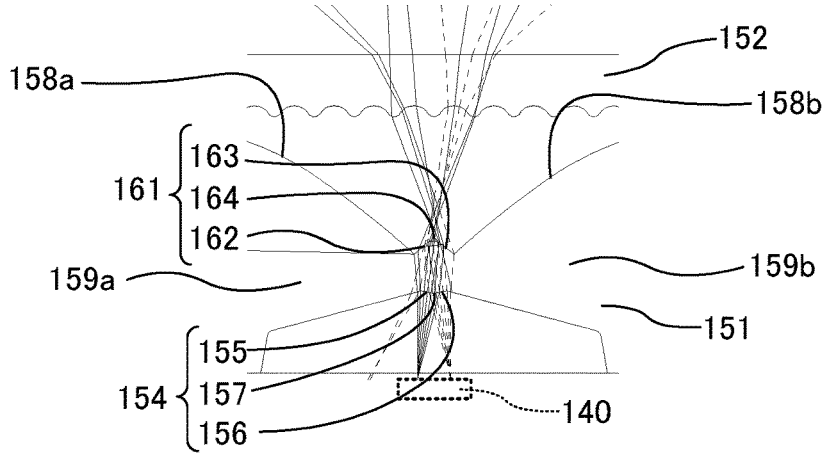

FIG. 9A to FIG. 12C show simulation results of light paths in light flux controlling members A to F. FIG. 9A to FIG. 9C show simulation results of light paths of light emitted from the center of the light emitting surface of light emitting element 140 in the case where light flux controlling member A, light flux controlling member B and light flux controlling member C (whose first projected line 154 has a first angle of 40°) were used. FIG. 10A to FIG. 10C show simulation results of light paths of light emitted from a region other than the center of the light emitting surface of light emitting element 140 in the case where light flux controlling member A, light flux controlling member B and light flux controlling member C (whose first projected line 154 has a first angle of 40°) were used. FIG. 11A to FIG. 11C show simulation results of light paths of light emitted from the center of the light emitting surface of light emitting element 140 in the case where light flux controlling member D, light flux controlling member E and light flux controlling member F (whose first projected line 154 has a first angle of 160°)were used. FIG. 12A to FIG. 12C show simulation results of light paths of light emitted from a region other than the center of the light emitting surface of light emitting element 140 in the case where light flux controlling member D, light flux controlling member E and light flux controlling member F (whose first projected line 154 has a first angle of 160°) were used. It is to be noted that, in FIG. 9A to FIG. 12C, the total reflection surface disposed on first inclined surface 155 side (the left side in the drawing) is first total reflection surface 158*a*, and the total reflection surface disposed on second inclined surface 156 side (the right side in the drawing) is second total reflection surface 158*b*. In addition, the light guiding part disposed on first inclined surface 155 side (the left side in the drawing) is first light guiding part 159*a*, and the light guiding part disposed on second inclined surface 156 side (the right side in the drawing) is second light guiding part 159*b*. Further, in FIG. 9A to FIG. 12C, the light beam emitted to first inclined surface 155 side (the left side in the drawing) with respect to the virtual plane (optical axis CA) is indicated with solid line, and the light beam emitted to second inclined surface 156 side (the right side in the drawing) with respect to the virtual plane (optical axis CA) is indicated with broken line. In addition, in FIG. 9A to FIG. 12C, hatching of light flux controlling members A to F is omitted to illustrate the light paths.

Figure 9B:
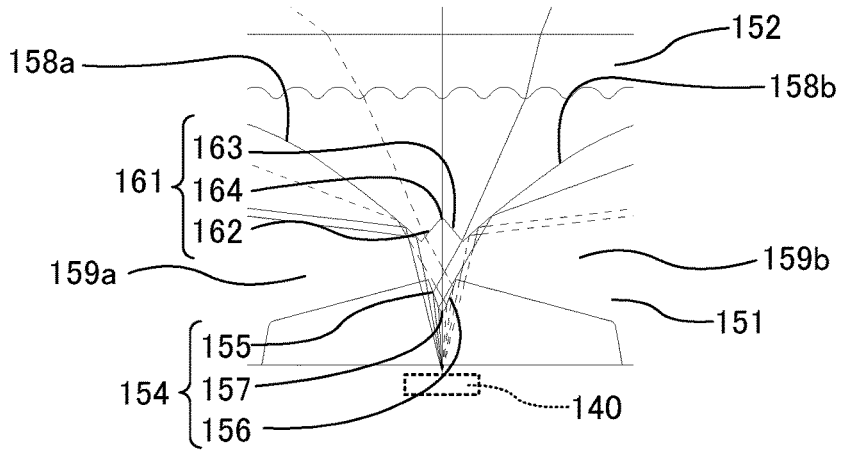
Figure 9C:
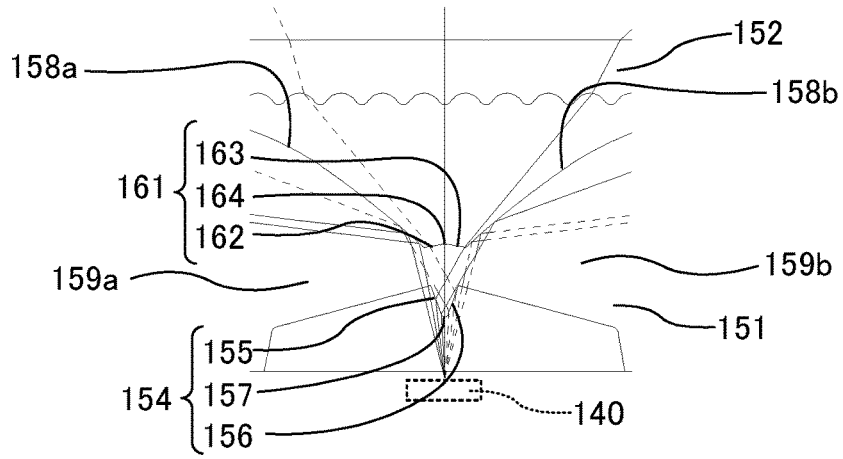

As shown in FIG. 9A to FIG. 9C, when light flux controlling member A, light flux controlling member B and light flux controlling member C (including first projected line 154 whose first angle is 40°) are used, a part of light which is emitted from the center of the light emitting surface of light emitting element 140 and is incident on first projected line 154 is largely refracted to the virtual plane side. To be more specific, a part of light incident on first inclined surface 155 of first projected line 154 reaches second light guiding part 159*b*. In addition, another part of the light incident on first inclined surface 155 reaches fourth inclined surface 163 of second projected line 161. Likewise, a part of light incident on second inclined surface 156 of first projected line 154 reaches first light guiding part 159*a*. In addition, another part of the light incident on second inclined surface 156 reaches third inclined surface 162 of second projected line 161.

In addition, as shown in FIG. 10A to FIG. 10C, when light flux controlling member A, light flux controlling member B and light flux controlling member C (including first projected line 154 whose first angle is 40°) are used, light which is emitted from a region other than the center of the light emitting surface of light emitting element 140 and is incident on first projected line 154 is largely refracted to the virtual plane side. To be more specific, a part of light incident on first inclined surface 155 of first projected line 154 is reflected by second inclined surface 156, and reaches third inclined surface 162 of second projected line 161 or first light guiding part 159*a*. In addition, another part of the light incident on first inclined surface 155 of first projected line 154 reaches fourth inclined surface 163 of second projected line 161 or second light guiding part 159*b*. Likewise, a part of light incident on second inclined surface 156 of first projected line 154 is reflected by first inclined surface 155, and reaches fourth inclined surface 163 of second projected line 161 or second light guiding part 159*b*. In addition, another part of the light incident on second inclined surface 156 of first projected line 154 reaches third inclined surface 162 of second projected line 161 or first light guiding part 159*a*.

In addition, as shown in FIG. 11A to FIG. 11C, when light flux controlling member D, light flux controlling member E and light flux controlling member F (including first projected line 154 whose first angle is 160°) are used, light which is emitted from the center of the light emitting surface of light emitting element 140 and is incident on first projected line 154 is slightly refracted to the light virtual plane side, and reaches second projected line 161 (third inclined surface 162 or fourth inclined surface 163). In addition, as shown in FIG. 12A to FIG. 12C, when light flux controlling member D, light flux controlling member E and light flux controlling member F (including first projected line 154 whose first angle is 160°) are used, light which is emitted from a region other than the center of the light emitting surface of light emitting element 140 and is incident on first projected line 154 is slightly refracted to the light virtual plane side, and reaches second projected line 161 (third inclined surface 162 or fourth inclined surface 163).

The direction of light emitted from second projected line 161 significantly differs depending on the first angle of first projected line 154 and the second angle of second projected line 161. For example, as shown in FIG. 9A to FIG. 9C, the emission angle, with respect to light optical axis LA, of light emitted from the center of the light emitting surface of light emitting element 140 which is incident on first projected line 154 whose first angle is 40° and is emitted from second projected line 161 decreases as the second angle of second projected line 161 increases. In addition, as shown in FIG. 11A to FIG. 11C, the emission angle, with respect to light optical axis LA, of the light emitted from a region other than the center of the light emitting surface of light emitting element 140 which is incident on first projected line 154 whose first angle is 40° and is emitted from second projected line 161 decreases as the second angle of second projected line 161 increases.

On the other hand, as shown in FIG. 10A to FIG. 10C, the emission angle, with respect to light optical axis LA, of light emitted from the center of the light emitting surface of light emitting element 140 which is incident on first projected line 154 whose first angle is 160°, and is emitted from second projected line 161 decreases as the second angle of second projected line 161 increases. In addition, as shown in FIG. 12A to FIG. 12C, the emission angle, with respect to light optical axis LA, of emitted from a region other than the center of the light emitting surface of light emitting element 140 which is incident on first projected line 154 whose first angle is 160° and is emitted from second projected line 161 decreases as the second angle of second projected line 161 increases.

As illustrated in FIG. 9A to FIG. 12C, in light flux controlling members A to F according to the present embodiment, the amount of light directed toward a portion immediately above light emitting element 140 can be largely adjusted by adjusting the first angle of first projected line 154, and the amount of light directed toward a portion immediately above light emitting element 140 can be finely adjusted by adjusting the second angle of second projected line 161.

(Simulation 1 of Luminance Distribution of Illumination Apparatus)

In Simulation 1, the luminance distribution was simulated in illumination apparatus 100 according to the present embodiment in which the distance between the surface of substrate 120 and the uppermost portion of the internal surface of cover 180 (the space distance) is 16 mm. In Simulation 1, light flux controlling members A to F were used. In addition, for comparison, luminance distribution was simulated also in an illumination apparatus according to a comparative example including light flux controlling member G according to the comparative example which does not include first projected line 154 or second projected line 161. It is to be noted that two total reflection surfaces 158 are connected with each other with a plane in light flux controlling member G.

In this simulation, two light emitting elements 140 (white LED) were disposed on substrate 120 such that the center distance is 28 mm, and light flux controlling member 150 (light flux controlling members A to G) having a length of 38 mm and a height of 6.7 mm was disposed over each light emitting element 140. In addition, the space distance was set to 16 mm, and the internal diameter of cover 180 was set to 24 mm.

Figure 13A:
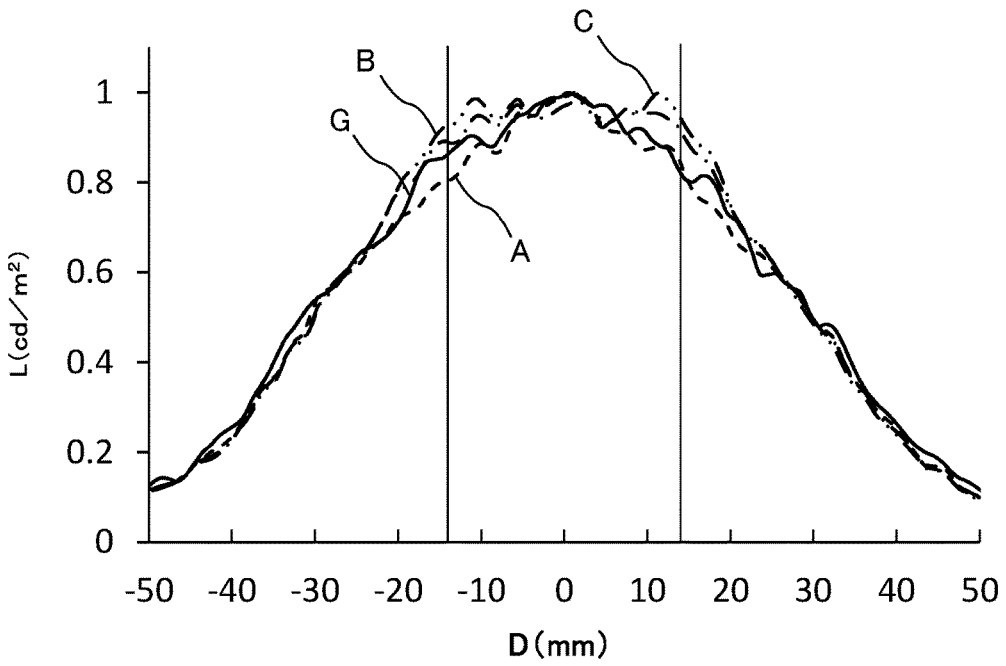
FIG. 13A is a graph showing luminance distributions in illumination apparatuses using light flux controlling member A, light flux controlling member B, light flux controlling member C and light flux controlling member G.
Figure 13B:
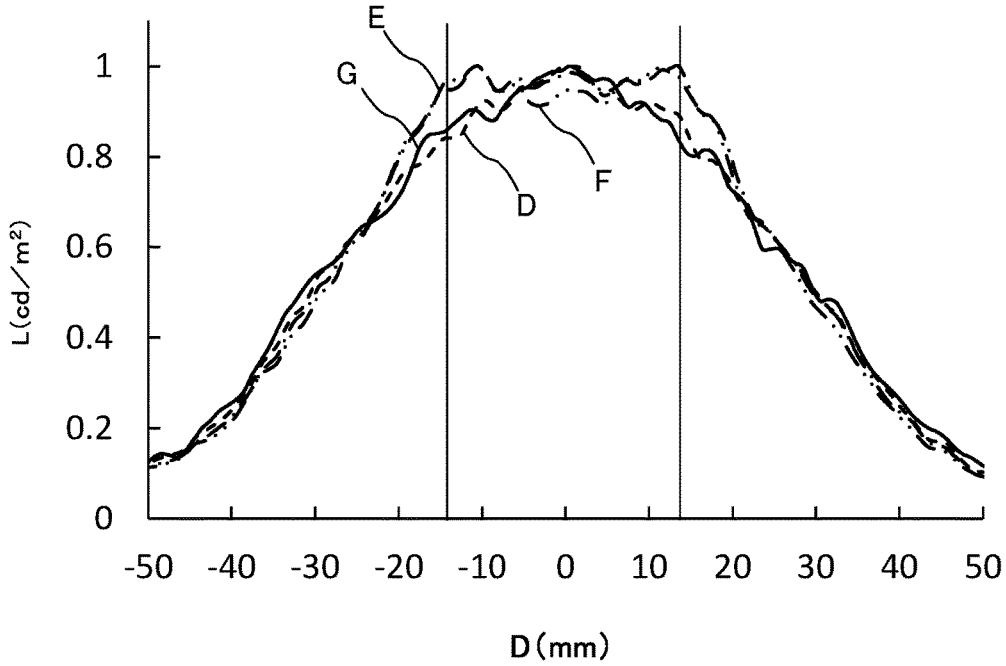
FIG. 13B is a graph showing luminance distributions in illumination apparatuses using light flux controlling member D, light flux controlling member E, light flux controlling member F and light flux controlling member G.

FIG. 13A and FIG. 13B are graphs showing a simulation result of a luminance distribution of an illumination apparatus. FIG. 13A is a graph showing a simulation result obtained with use of light flux controlling members A to C including first projected line 154 whose first angle is 40°. The solid line of FIG. 13A indicates a simulation result of light flux controlling member G according to the comparative example. In FIG. 13A, the broken line indicates a simulation result obtained with use of light flux controlling member A, the dashed line indicates a simulation result obtained with use of light flux controlling member B, and the chain double-dashed line indicates a simulation result obtained with use of light flux controlling member C. FIG. 13B is a graph showing a simulation result obtained with use of light flux controlling members D to F including first projected line 154 whose first angle is 160°. In FIG. 13B, the solid line indicates a simulation result of light flux controlling member G according to the comparative example. In FIG. 13B, the broken line indicates a simulation result obtained with use of light flux controlling member D, the dashed line indicates a simulation result obtained with use of light flux controlling member E, and the chain double-dashed line indicates a simulation result obtained with use of light flux controlling member F. In addition, in FIG. 13A and FIG. 13B, the straight lines extending in the vertical direction indicate the positions of two optical axes LA of light emitting elements 140.

As illustrated in FIG. 13A and FIG. 13B, in this simulation, it was confirmed that, when light flux controlling member G which does not include first projected line 154 or second projected line 161 was used, a bright spot is formed between light emitting elements 140 adjacent to each other, and a dark point is formed at a portion immediately above light emitting element 140. In addition, it was confirmed that, in illumination apparatus 100 in which the space distance is long, uniform luminance can be achieved with illumination apparatus 100 in its entirety by collecting light at a portion immediately above light emitting element 140 by increasing the first angle of first projected line 154 and the second angle of second projected line 161 (see light flux controlling member C of FIG. 13A (chain double-dashed line) and light flux controlling member F of FIG. 13B (chain double-dashed line)).

(Simulation 2 of Luminance Distribution of Illumination Apparatus)

Next, in Simulation 2, the luminance distribution was simulated in illumination apparatus 100 according to the present embodiment in which the space distance is 13 mm. Also in Simulation 2, light flux controlling members A to G were used. The conditions of Simulation 2 are identical to those of Simulation 1 except that the space distance was 13 mm.

Figure 14A:
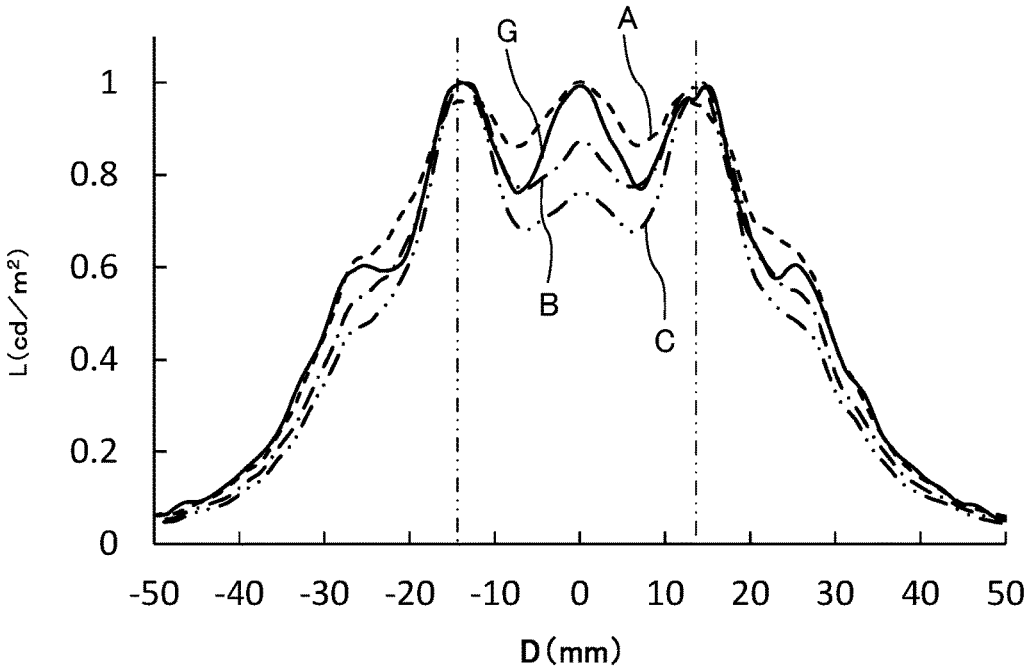
FIG. 14A is a graph showing luminance distributions in illumination apparatuses using light flux controlling member A, light flux controlling member B, light flux controlling member C and light flux controlling member G.
Figure 14B:
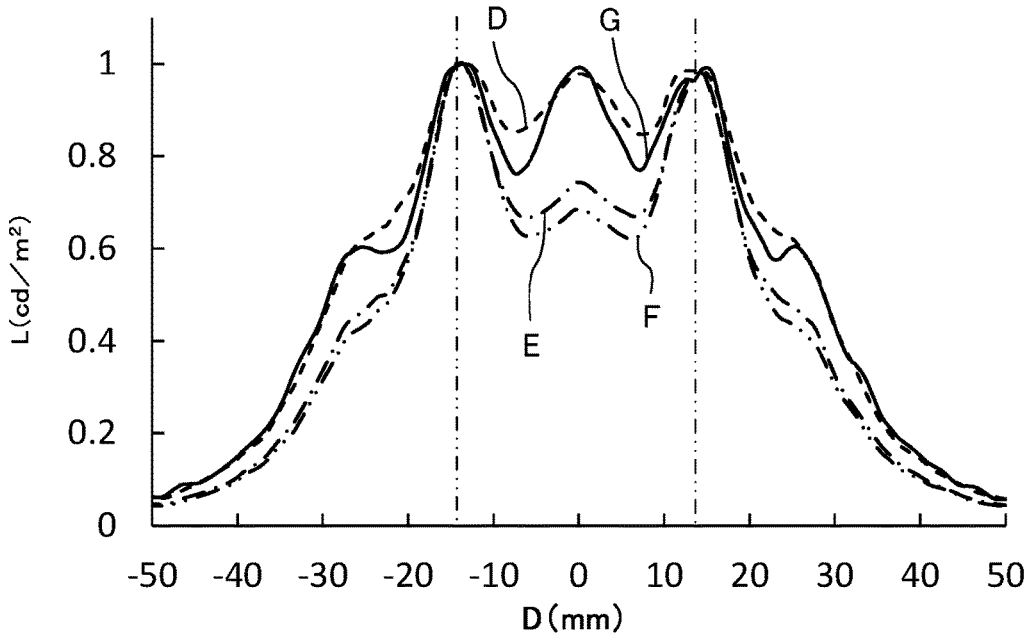
FIG. 14B is a graph showing luminance distributions in illumination apparatuses using light flux controlling member D, light flux controlling member E, light flux controlling member F and light flux controlling member G.

FIG. 14A and FIG. 14B are graphs showing a simulation result of a luminance distribution of an illumination apparatus. FIG. 14A is a graph showing a simulation result obtained with use of light flux controlling members A to C including first projected line 154 whose first angle is 40°. In FIG. 14A, the solid line indicates a simulation result of light flux controlling member G according to the comparative example. In FIG. 14A, the broken line indicates a simulation result obtained with use of light flux controlling member A, the dashed line indicates a simulation result obtained with use of light flux controlling member B, and the chain double-dashed line indicates a simulation result obtained with use of light flux controlling member C. FIG. 14B is a graph showing a simulation result obtained with use of light flux controlling members D to F including first projected line 154 whose first angle is 160°. In FIG. 14B, the solid line indicates a simulation result of light flux controlling member G according to the comparative example. In FIG. 14B, the broken line indicates a simulation result obtained with use of light flux controlling member D, the dashed line indicates a simulation result obtained with use of light flux controlling member E, and the chain double-dashed line indicates a simulation result obtained with use of light flux controlling member F. In addition, in FIG. 14A and FIG. 14B, the straight lines extending in the vertical direction indicate the positions of two optical axes LA of light emitting elements 140.

As illustrated in FIG. 14A and FIG. 14B, in this simulation, it was confirmed that, when light flux controlling member G which does not include first projected line 154 or second projected line 161 was used, a dark point is formed on both sides of light emitting element 140. In addition, it was confirmed that, in illumination apparatus 100 in which the space distance is short, uniform luminance can be achieved with illumination apparatus 100 in its entirety by increasing the quantity of light emitted to the both sides of light emitting element 140 by reducing the first angle of first projected line 154 and the second angle of second projected line 161 (see light flux controlling member A of FIG. 14A (broken line) and light flux controlling member D of FIG. 14B (broken line)).

(Effect)

As described above, in illumination apparatus 100 according to the present embodiment, by appropriately adjusting the first angle of first projected line 154 and the second angle of second projected line 161, the brightness of a portion immediately above light emitting element 140 can be appropriately adjusted, and luminance unevenness in the arrangement direction of light emitting element 140 can be reduced. In addition, the brightness between each light emitting element 140 can be appropriately adjusted with total reflection surface 158 and light guiding part 159. Further, by disposing second light flux controlling member (diffusion transmission member) 152 including recessed line (diffusion transmission part) 174 on the light path of light which passes through second projected line 161, the quantity of light emitted from the effective light emission region of illumination apparatus 100 can be uniformized.

While light flux controlling member 150 includes first projected line 154 and second projected line 161 in the embodiment, second projected line 161 may be omitted. In this case, a plane perpendicular to optical axis LA is disposed between two total reflection surfaces 158. Also in this case, luminance unevenness in the arrangement direction of light emitting element 140 can be reduced.

In addition, while light flux controlling member 150 includes first light flux controlling member (light flux controlling member main body) 151 and second light flux controlling member (diffusion transmission member) 152 in the embodiment, light flux controlling member 150 according to the present invention may not include second light flux controlling member (diffusion transmission member) 152. Also in this case, the luminance unevenness in the arrangement direction of light emitting element 140 can be reduced.

This application is entitled to and claims the benefit of Japanese Patent Application No. 2014-185333 filed on Sep. 11, 2014, the disclosure of which including the specification, drawings and abstract is incorporated herein by reference in its entirety.

INDUSTRIAL APPLICABILITY

The illumination device of the embodiment of the present invention can be used in place of fluorescent tubes, and is therefore widely applicable to various kinds of illumination devices.

REFERENCE SIGNS LIST

10, 10' Light flux controlling member
12 Incidence surface
14 Total reflection surface
16 Emission surface
18 Region around boundary line of total reflection surface
100 Illumination apparatus
110 Frame
120 Substrate
130 Light-emitting device
140 Light emitting element
150 Light flux controlling member
151 First light flux controlling member (light flux controlling member main body)
152 Second light flux controlling member (diffusion transmission member)
153 Incidence surface
154 First projected line
155 First inclined surface
156 Second inclined surface
157 First ridgeline
158 Total reflection surface
159 Light guiding part
160 Emission surface
161 Second projected line
162 Third inclined surface
163 Fourth inclined surface
164 Second ridgeline
165 First recess
166 Light guiding part main body
167 Reinforcement member
169 Guide engagement groove
170 Second recess
171 Engagement protrusions
172 Half cylinder part
173 Side wall part
174 Recessed line
176 Protrusion part
180 Cover

The invention claimed is:

1. A light flux controlling member including a light flux controlling member main body and configured to control a distribution of light emitted from a light emitting element, the light flux controlling member main body comprising:

two incidence surfaces disposed on both sides of a virtual plane as a boundary, the virtual plane including an optical axis of the light emitting element, the incidence surfaces being configured to allow incidence of a part of the light emitted from the light emitting element;

a first projected line including a first inclined surface, a second inclined surface paired with the first inclined surface, and a first ridgeline configured to connect the first inclined surface and the second inclined surface, the first projected line being disposed such that the first ridgeline covers the light emitting element along the virtual plane at a position between the two incidence surfaces, the first projected line being configured to allow incidence of another part of the light emitted from the light emitting element;

two total reflection surfaces formed at positions opposite to the light emitting element with the incidence surface therebetween, the two total reflection surfaces being configured to reflect a part of light incident on the incidence surface in two opposite directions which are substantially perpendicular to the optical axis;

two light guiding parts disposed at respective opposing positions with the incidence surface, the first projected line and the total reflection surface therebetween, the two light guiding parts being configured to guide a part of the light incident on the incidence surface and light reflected by the total reflection surface; and two emission surfaces formed on an external surface of the light guiding part and configured to emit light guided by the light guiding part to outside of the light flux controlling member main body.

2. The light flux controlling member according to claim 1, further comprising a diffusion transmission member including a diffusion transmission part, the diffusion transmission part being disposed over the light flux controlling member main body with an air layer therebetween to cover the incidence surface, the first projected line and the total reflection surface, the diffusion transmission part being configured to allow light which is incident on the first projected line and is emitted from the light flux controlling member main body to pass therethrough while diffusing the light.

3. The light flux controlling member according to claim 2, wherein:

the light flux controlling member main body further includes a second projected line including a third inclined surface, a fourth inclined surface paired with the third inclined surface, and a second ridgeline configured to connect the third inclined surface and the fourth inclined surface, and the second projected line being disposed such that the second ridgeline covers the first projected line along the virtual plane at a position between the two total reflection surfaces, the second projected line being configured to emit a part of light incident on the first projected line to outside of the light flux controlling member main body; and the diffusion transmission part allows light emitted from the second projected line to pass therethrough while diffusing the light.

4. The light flux controlling member according to claim 1, wherein, in the virtual plane, the first projected line allows incidence of light which is emitted from the light emitting element at an angle of at least 45° with respect to the optical axis of the light emitting element.

5. A light-emitting device comprising:

a light emitting element; and the light flux controlling member according to claim 1.

6. An illumination apparatus comprising:

a plurality of the light-emitting devices according to claim 5; and a cover disposed to cover the plurality of light-emitting devices with an air layer interposed between the cover and each of the light-emitting devices.

7. The light flux controlling member according to claim 2, wherein, in the virtual plane, the first projected line allows incidence of light which is emitted from the light emitting element at an angle of at least 45° with respect to the optical axis of the light emitting element.

8. The light flux controlling member according to claim 3, wherein, in the virtual plane, the first projected line allows incidence of light which is emitted from the light emitting element at an angle of at least 45° with respect to the optical axis of the light emitting element.

9. A light-emitting device comprising:

a light emitting element; and the light flux controlling member according to claim 2.

10. A light-emitting device comprising:

a light emitting element; and the light flux controlling member according to claim 3.

11. A light-emitting device comprising:

a light emitting element; and the light flux controlling member according to claim 4.

12. A light-emitting device comprising:

a light emitting element; and the light flux controlling member according to claim 7.

13. A light-emitting device comprising:

a light emitting element; and the light flux controlling member according to claim 8.

14. A light-emitting device comprising:

a light emitting element; and the light flux controlling member according to claim 9.

15. A light-emitting device comprising:

a light emitting element; and the light flux controlling member according to claim 10.

16. A light-emitting device comprising:

a light emitting element; and the light flux controlling member according to claim 11.

17. A light-emitting device comprising:

a light emitting element; and the light flux controlling member according to claim 12.

18. A light-emitting device comprising:

a light emitting element; and the light flux controlling member according to claim 13.

* * * * *